US008740715B2

(12) United States Patent
Zealer

(10) Patent No.: US 8,740,715 B2
(45) Date of Patent: Jun. 3, 2014

(54) CONNECTION AND ILLUMINATION APPARATUS FOR A LEVITATING SYSTEM

(76) Inventor: Carl Zealer, Canal Winchester, OH (US)

( * ) Notice: Subject to any disclaimer, the term of this patent is extended or adjusted under 35 U.S.C. 154(b) by 153 days.

(21) Appl. No.: 13/371,983

(22) Filed: Feb. 13, 2012

(65) Prior Publication Data

US 2012/0208650 A1 Aug. 16, 2012

Related U.S. Application Data

(60) Provisional application No. 61/473,466, filed on Apr. 8, 2011, provisional application No. 61/441,995, filed on Feb. 11, 2011.

(51) Int. Cl.
*A63J 5/12* (2006.01)
*A63J 21/00* (2006.01)

(52) U.S. Cl.
USPC ..... 472/68; 472/72

(58) Field of Classification Search
CPC ..... A63J 1/00; A63J 5/12; A63J 7/00; A63J 21/00; A63H 37/00
USPC ..... 472/68, 70, 72, 73, 75
See application file for complete search history.

(56) References Cited

U.S. PATENT DOCUMENTS 4,802,875 A * 2/1989 Cunningham ..... 446/46
5,254,077 A 10/1993 Nottingham et al.
6,443,848 B1 * 9/2002 Sisofo ..... 472/68
8,142,295 B2 * 3/2012 Mesika ..... 472/68
2009/0176433 A1 7/2009 Forti
2011/0177871 A1 7/2011 Mesika

OTHER PUBLICATIONS

PCT/US2012/024877 Written Opinion of the International Searching Authority dated May 21, 2012.
PCT/US2012/024877 International Search Report dated dated May 21, 2012.
Jscherrer7. 'Mystify.wmv'.youtube.com; Jan. 27, 2011; online, retrieved on May 7, 2012; Retrieved from the internet: <URL: http://www.youtube.com/watch?v=hBGnskAdfzY>.
Baker, Lisa C.; 'Hummer Card Magic Tricks Revealed'; eHow.com; Jun. 3, 2010; online, retrieved on May 7, 2012; Retrieved from the internet: <URL:http://web.archive.org/web/20100603202129/http://www.ehow.com/way_5492508_hummer-card-magic-tricks-revealed.html >.

* cited by examiner

*Primary Examiner* — Kien Nguyen
(74) *Attorney, Agent, or Firm* — Kegler Brown Hill & Ritter; James J. Pingor

(57) ABSTRACT

A system and method of performing a mystical card flying illusion or 'trick' is provided. In accordance with the innovation, an invisible (or near invisible) levitation means (e.g., string, thread, etc.) can be used to create the illusion of a levitating and/or spinning playing card. The levitation means can be pre-attached or fixedly attached to an ear piece that is configured to fit over and behind a user's ear. Further, an illumination system can be provided in connection with the levitation illusion system. Moreover, spinning aides can be provided to assist a user in rotating or spinning a levitation item (e.g., card).

29 Claims, 11 Drawing Sheets

CONNECTION AND ILLUMINATION APPARATUS FOR A LEVITATING SYSTEM

CROSS-REFERENCE TO RELATED APPLICATIONS

This application claims the benefit of U.S. Provisional Patent application Ser. No. 61/441,995 entitled LEVITATING CARD SYSTEM AND METHOD THEREOF filed on Feb. 11, 2011 and to U.S. Provisional Patent application Ser. No. 61/473,466 entitled LEVITATION ILLUSION ILLUMINATION SYSTEM filed on Apr. 8, 2011. The entireties of the above-noted applications are incorporated by reference herein.

ORIGIN

The innovation disclosed herein is related to illusions and more specifically, to a string apparatus attached to an object to give the illusion that the object levitates.

BACKGROUND

Magic is a performing art that entertains an audience by creating illusions of seemingly impossible or supernatural feats, often using purely natural means. These feats are often called magic tricks, effects or illusions. One who performs such illusions is most often referred to as a magician or illusionist.

Card magic is a specific type of magic that usually deals with creating magical effects using a deck of playing cards. Traditionally, card magic was commonplace in magical performances, especially in close up magic, such as parlor or street magic. Over the years, playing cards became popular with magicians because cards are inexpensive, versatile, and easily available. Although magicians have created and presented myriad of illusions with cards, sometimes referred to 'card tricks', most of these illusions are generally considered to be built upon similar principles and techniques.

Card magic, in one form or another, likely dates from the time playing cards became commonly known, towards the second half of the fourteenth century, but its history in this period is largely undocumented. Due to versatility as a prop, card magic has become very popular amongst modern magicians. While many card tricks use a complete deck of playing cards, oftentimes, individual cards are used to create mystifying illusions such as a spinning and seemingly floating cards.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

The innovation disclosed and claimed herein, in one aspect thereof, comprises a system and method of performing a mystical card flying illusion or 'trick.' In accordance with the innovation, an invisible (or near invisible) levitation means (e.g., string, thread, etc.) can be employed to create the illusion of levitating and/or spinning a playing card. The levitation means can be pre-attached or fixedly attached to an ear piece that is configured to fit over and behind a user's ear.

In another aspect, the innovation discloses a system that facilitates an illusion of levitating an item comprising a levitation item, a connection means attached to a user, and a levitation means providing a connection between the levitation item and the connection means, whereby the levitation means provides a means to facilitate the illusion of floating the levitation item based on actions of the user.

In other aspects of the subject innovation the levitation means can be pre-attached or otherwise fixedly attached to eyeglasses, headwear, hair accessories or the like so as to create an illusion of a levitating card.

In still other aspects, the innovation discloses an illumination system that can be applied to a levitation item thereby enhancing the visual experience. The illumination system can include two members (e.g., top and bottom) that can attach around a levitation item, such as a playing card. The system can be equipped with one or a set (or more) of LEDs or other illumination devices. A power source can be provided and, in one aspect, positioned beneath the playing card. A levitation means can be attached to an attachment pad upon the top of the card. Further, optional spinning aides can be affixed so as to assist in initiating rotation of the card. In aspects, the illumination devices can be powered light sources (e.g., LEDs) or, alternatively, a glow-in-the-dark device or a device that illuminates upon motion not requiring an external power source, or combinations thereof.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
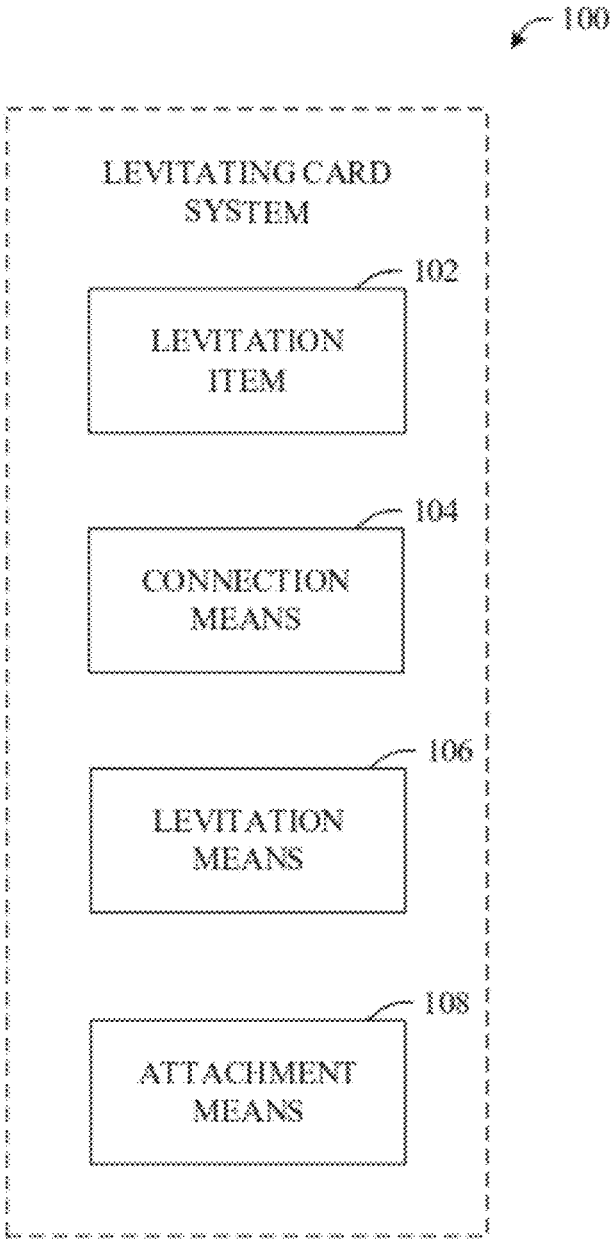
FIG. 1 illustrates an example block diagram of a levitating system in accordance with an aspect of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

Referring initially to the drawings, FIG. 1 illustrates an example block diagram of a levitating system 100 in accordance with aspects of the innovation. As shown, the levitating system 100 can include a levitation item 102, a connection means 104, a levitation means 106, and an attachment means 108. In alternative embodiments, the levitating system 100 can include illumination devices and/or spinning aides, which assist the levitation item 102 to spin, as will be described further below.

Referring to FIGS. 1 and 2A-2D, it is to be appreciated, that the levitation item 102 can be most any suitable object, such as but not limited to a playing card, a credit card, a dollar bill, a business card, a coin, a ball, a pencil, etc. The connection means 104 can be most any suitable object that provides a means to connect the levitating item 102 to a user performing the illusion, such as but not limited to an ear piece (over-the-ear, in-the-ear bud, etc.), eyeglasses, headwear (e.g. hat, visor, band, etc.), hair accessories, etc. The levitation means 106 can be most any suitable means to connect the levitation means 102 with the connection means 104, such as but not limited to thread, string, fishing line, etc. It is to be appreciated, that the levitation means 106 can be any color and/or transparent so as to appear invisible (or nearly invisible) such that a spectator cannot notice it upon viewing the illusion.

The attachment means 108 can be most any suitably pliable material to attach the levitation means 106 to the levitating item 102 and/or to the connection means 104, such as but not limited to wax, putty, sticky tack, adhesive, tab, etc. In the example embodiment illustrated in FIG. 2A-2D, the levitation item 102 is a playing card 202, the connection means 104 is an over-the-ear type ear piece 204, the levitation means 106 is a piece of thread 206, and the attachment means 108 is wax 208. It is to be appreciated that the ear piece 204 can be the type that fits into the ear. In addition, it is to be appreciated that the ear piece 204 described herein can be made of most any suitably rigid material including, but not limited to, plastic, rubber, metal, composite, alloy, wood or the like and can be shaped in a manner such that it can be easily fit over the user's ear and equipped with an end cap to enhance comfort.

It is to be appreciated that while in one embodiment, described below, the thread 206 is pre-attached to the ear piece 204. In other embodiments, however, the thread 206 can be replaced as desired. For example, to enhance the illusion of levitation, it might be beneficial to conceal the thread 206 by, for example, replacing the thread 206 with thread consistent with the user's shirt color. Further, in yet other embodiments, it is to be understood that thread color may correspond to a user's skill level. For example, a white string can be a novice string while a darker color (e.g., black) can correspond to a more advanced skill level. Still further, threads having different thicknesses can be employed with alternative aspects as appropriate or desired. Thus, the example embodiment illustrated in FIGS. 2A-2D and described herein is for illustrative purposes only and is not intended to limit the scope of the innovation. Similarly, the thread can be pre-attached to the object or levitation item without use of an attachment means (e.g., wax or adhesive). These alternatives are to be included within the scope of this disclosure and claims appended hereto.

Figure 2A:
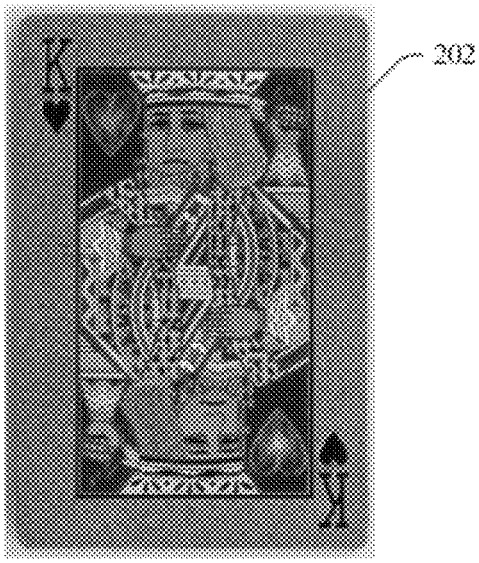
FIGS. 2A-2D illustrate an example levitating card system in accordance with an aspect of the innovation.
Figure 2C:
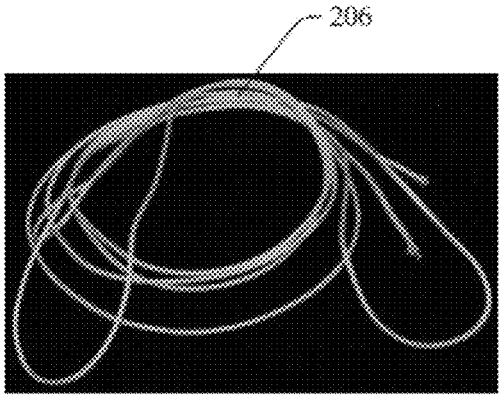
Figure 2B:
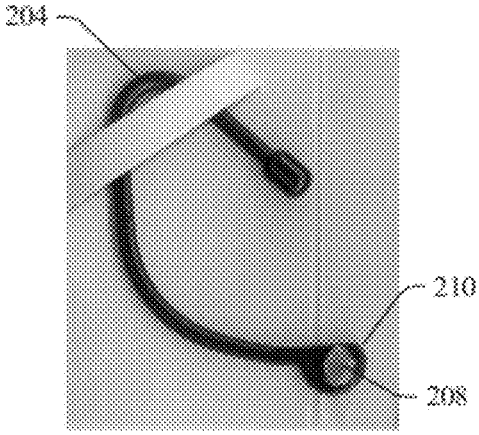
Figure 2D:
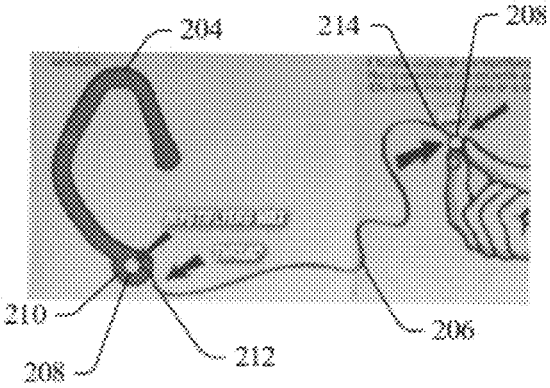
Figure 3:
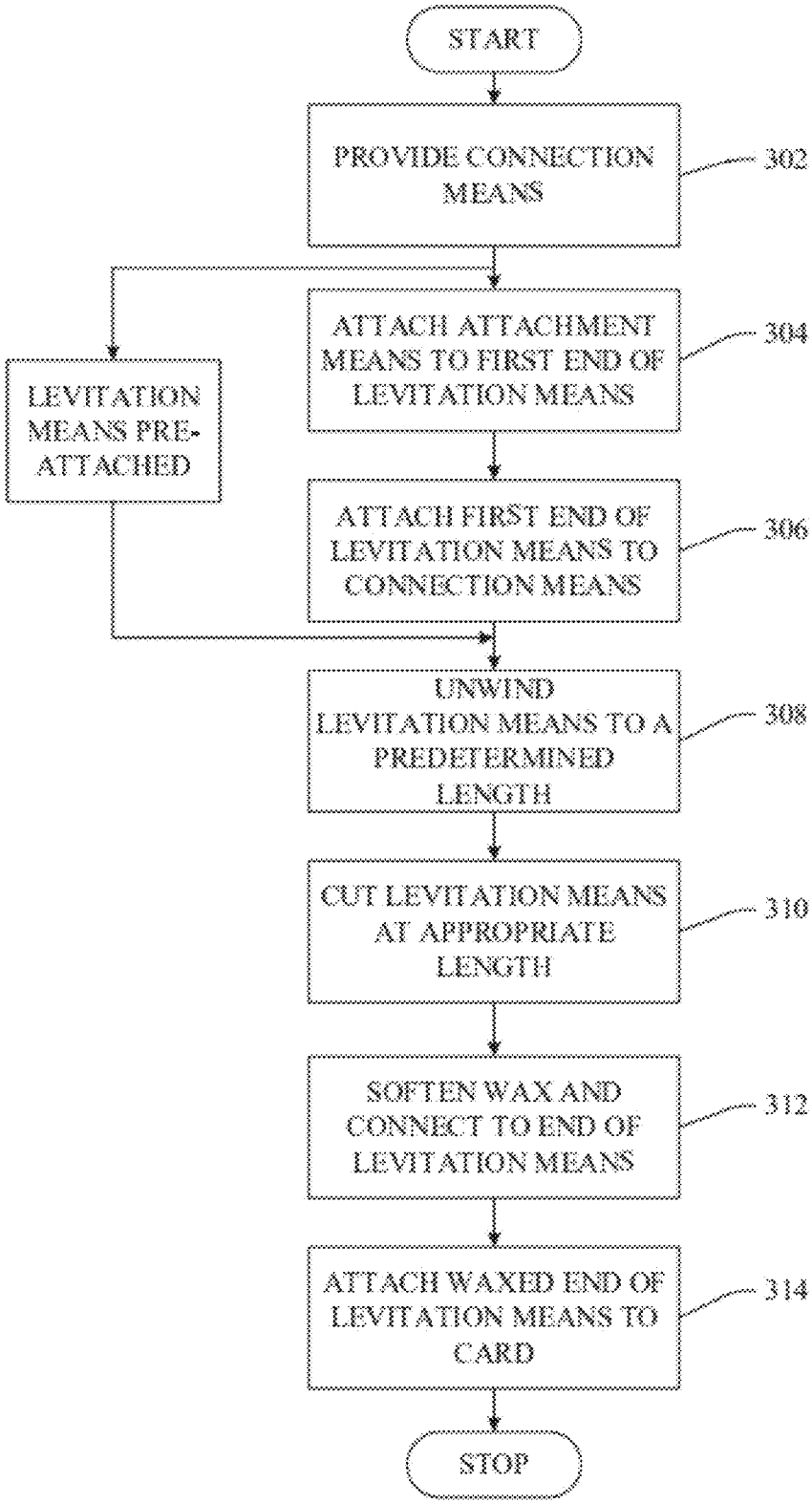
FIG. 3 illustrates an example flow chart of procedures that facilitate system preparation in accordance with an aspect of the innovation.

Referring to FIG. 3 and with reference to FIGS. 2A-2D, FIG. 3 illustrates a methodology of configuring the levitation system 100 in accordance with an aspect of the innovation. While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

At 302, the connection means 104 (ear piece 204) is provided with either the levitation means 106 (thread 206) pre-attached with the attachment means 108 (wax 208), as shown in FIG. 2B, or not attached. If the attachment means 108 is not attached to the connection means 104, then at 304, a small amount of the attachment means 108 is softened and attached to a first end 212 of the levitation means 106. The amount of attachment means 108 should be small enough to remain concealed to enhance the illusion. At 306, the first 212 end of the levitation means 106 is attached to a bottom 210 of the connection means 104 (ear piece 204) by pressing the attachment means 108 against the bottom 210 of the connection means 104. If the attachment means 108 is attached to the connection means 104, then 304 and 306 are bypassed and the method proceeds to 308. At 308, the levitation means 106 can be unwound or otherwise extended to a predetermined length. At 310, once the appropriate length of the levitation means 106 is unwound the levitation means 106 is then cut.

At 312, a small amount of the attachment means 108 is again softened and attached to a second (cut) end 214 of the levitation means 106. At 314, the second end 214 of the levitation means 106 is attached to the levitating item 102 by pressing the attachment means 108 against the levitating item 102. It is to be appreciated, that in order to enhance the illusion of levitation, the levitating item 102 should be balanced as much as possible. For example, in the embodiment disclosed herein, the wax 208 along with the second end 214 of the thread 206 should be placed as close as possible to the middle of the card 202, such that the card 202 hangs flat and straight, like a table.

Figure 4:
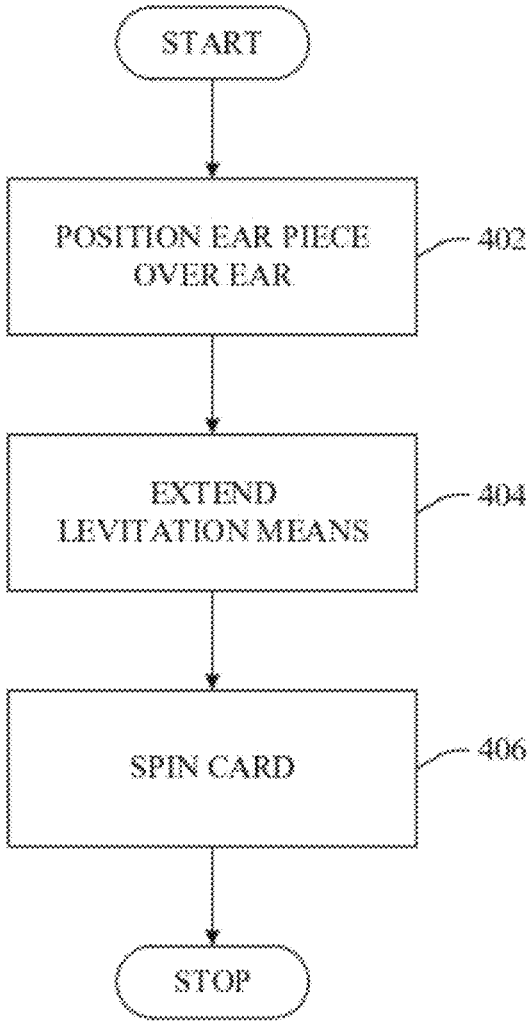
FIG. 4 illustrates an example flow chart of procedures that facilitate card levitation in accordance with an aspect of the innovation.

FIG. 4 is an example flow chart illustrating acts of levitating the levitation item 102 in accordance with the innovation. At 402, the connection means 104 is attached to the user performing the illusion. In the example embodiment disclosed herein, the ear piece 204 is positioned over the user's ear. At 404, the levitation means 104 (thread 204) can be extended having the levitation item 102 (card 202) attached thereto. At 406, the levitation item 102 can now be spun (see FIG. 5A) to perform the illusion of a levitating item or object. Specifically, because the levitating item 102 is suspended by an invisible (or nearly invisible) levitation means 106, the levitating item 102 appears to levitate. To further enhance the illusion, the first end 212 of the levitation means 206 can be attached behind the user's ear using a small piece of adhesive (e.g., a band-aid, tape, etc.) as opposed to using the connection means 104.

Figure 5A:
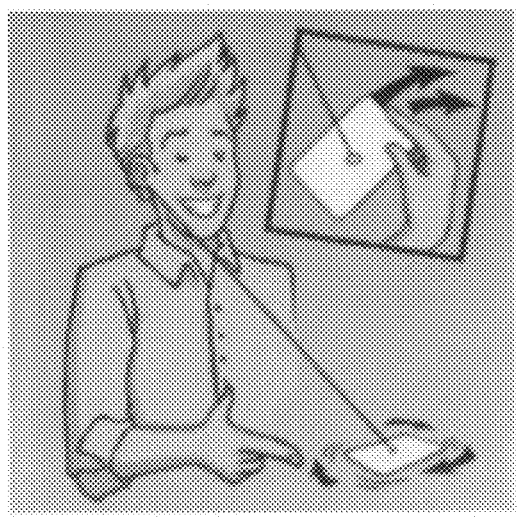
FIGS. 5A-5D illustrate example instructions for use of the levitating card system in accordance with aspects of the innovation.
Figure 5B:
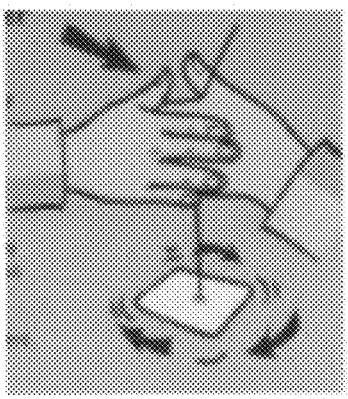
Figure 5C:
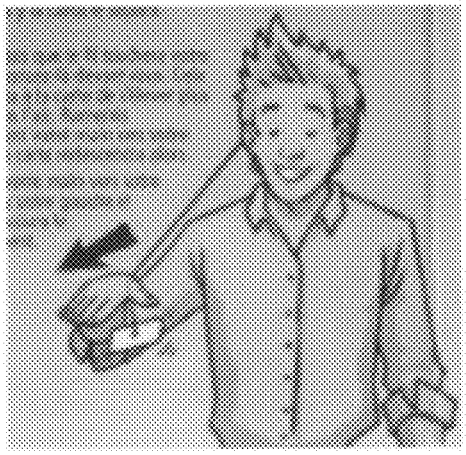
Figure 5D:
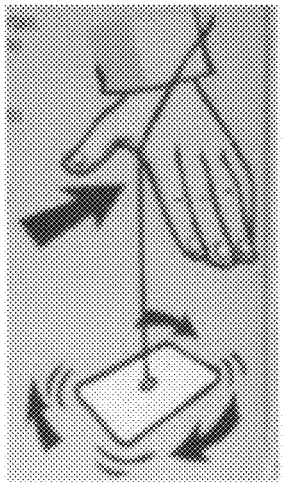

FIGS. 5A-5D are example illustrations of tips for practicing the illusion of levitation in accordance with aspects of the innovation. For example, FIG. 5A illustrates the proper technique for initially spinning the levitating item 102. FIG. 5B illustrates a technique for guiding or floating the levitating item 102 from hand to hand. FIGS. 5C and 5D illustrate example techniques of moving the levitating items 102 in an up and down direction. Specifically, once the levitating item 102 is spinning, the user contacts the levitation means 106 between their thumb and index finger and move their hand away from themselves (FIG. 5C) to raise the levitating item 102 and toward themselves (FIG. 5D) to lower the levitating item 102.

FIGS. 6-11 are illustrations of alternate embodiments of the levitation system 100 described above. Specifically, FIGS. 6-11 are examples of illumination devices and weighted objects to enhance the illusion.

Figure 6:
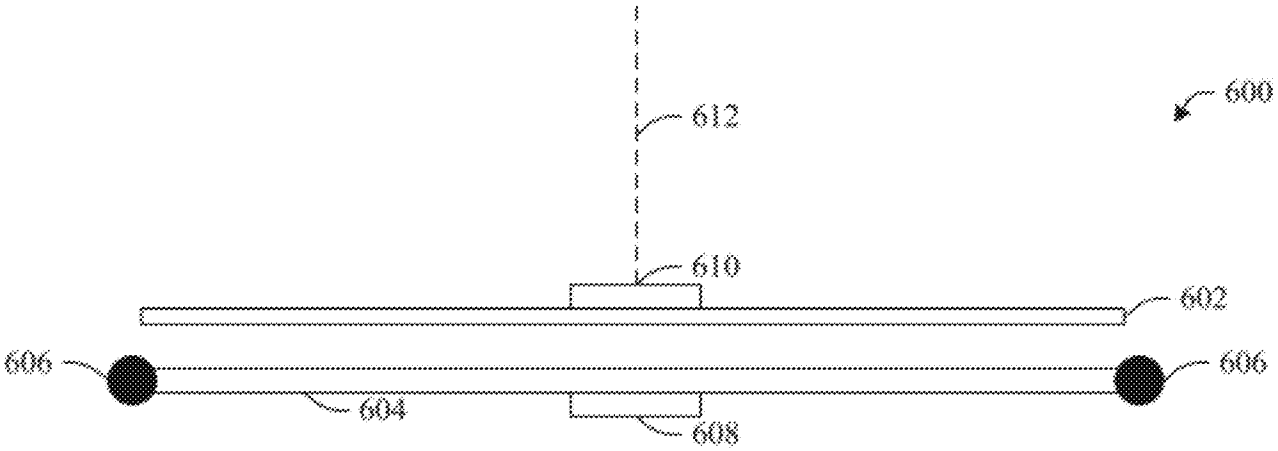
FIG. 6 illustrates an example illumination system in accordance with aspects of the innovation.

Referring to FIG. 6, an example illumination system 600 is shown in accordance with aspects of the innovation. Generally, in an aspect, the system 600 can include a first (upper) member 602, a second (lower) member 604, and multiple illumination devices 606 fixedly attached to opposite ends of the first member 602 and/or the second member 604. It is to be appreciated, that the illumination devices 606 can be attached at any location on either the first and/or second member 602, 604, as long as the illumination system 600 remains balanced. In the embodiment shown in FIG. 6, the illumination devices 606 are attached at each end of the second member 604. It is to be appreciated that the illumination devices 606 may be any suitable illuminating device, such as but not limited to, LED's, or other illuminating devices requiring a power source, illuminating devices not requiring a power source, such as but not limited to, glow in the dark devices, illuminating devices that illuminate upon motion (e.g., spinning), etc.

While multiple members are illustrated in FIG. 6, it is to be understood that the configuration can be modified into a single member having a slot sizably configured to accept the levitation item 102 described above. In further aspects of the innovation of FIG. 6, a fastening means, such as but not limited to magnets, clips, adhesives, etc. can be employed to affix the two members about the levitation item or card.

For illuminating devices requiring power, a power source compartment housing a power source 608, such as but not limited to a battery, can be provided and disposed about a centerline 612 between the illuminating devices 606 which, in this embodiment, are disposed at each end of the second member 604. It is to be understood that the power source 608 can be centered so as to not affect the equilibrium of the spinning levitation item 102. Opposite the power source 608 and positioned about the centerline 612 of the first member 602 is an attachment pad 610. In operation, the attachment pad 610 can be used as a position to connect or place the attachment means 108 (e.g. wax) and ultimately the levitation means 106 (e.g. thread 106). In other aspects, the attachment pad 610 can include a means by which the levitation means 106 can be threaded or otherwise attached. Still further, the levitation means 106 can be molded or pre-attached to the attachment pad 610. These and other aspects are to be included within the scope of this disclosure and claims appended hereto. As well, while specific configurations are shown and described, it is to be understood that alternatives exist which are to be included within the scope of this specification (e.g., omitted attachment pad 610).

So as to minimize and/or hide the appearance of the first and second members 602, 604, each of the first and second members 602, 604 can be manufactured of a clear, transparent or semi-transparent material so as to minimize notice-ability. In other words, because the first and second members 602, 604 can be transparent or clear, the ability to see them around the card is minimized, similar to that of the levitation means 106.

Figure 7:
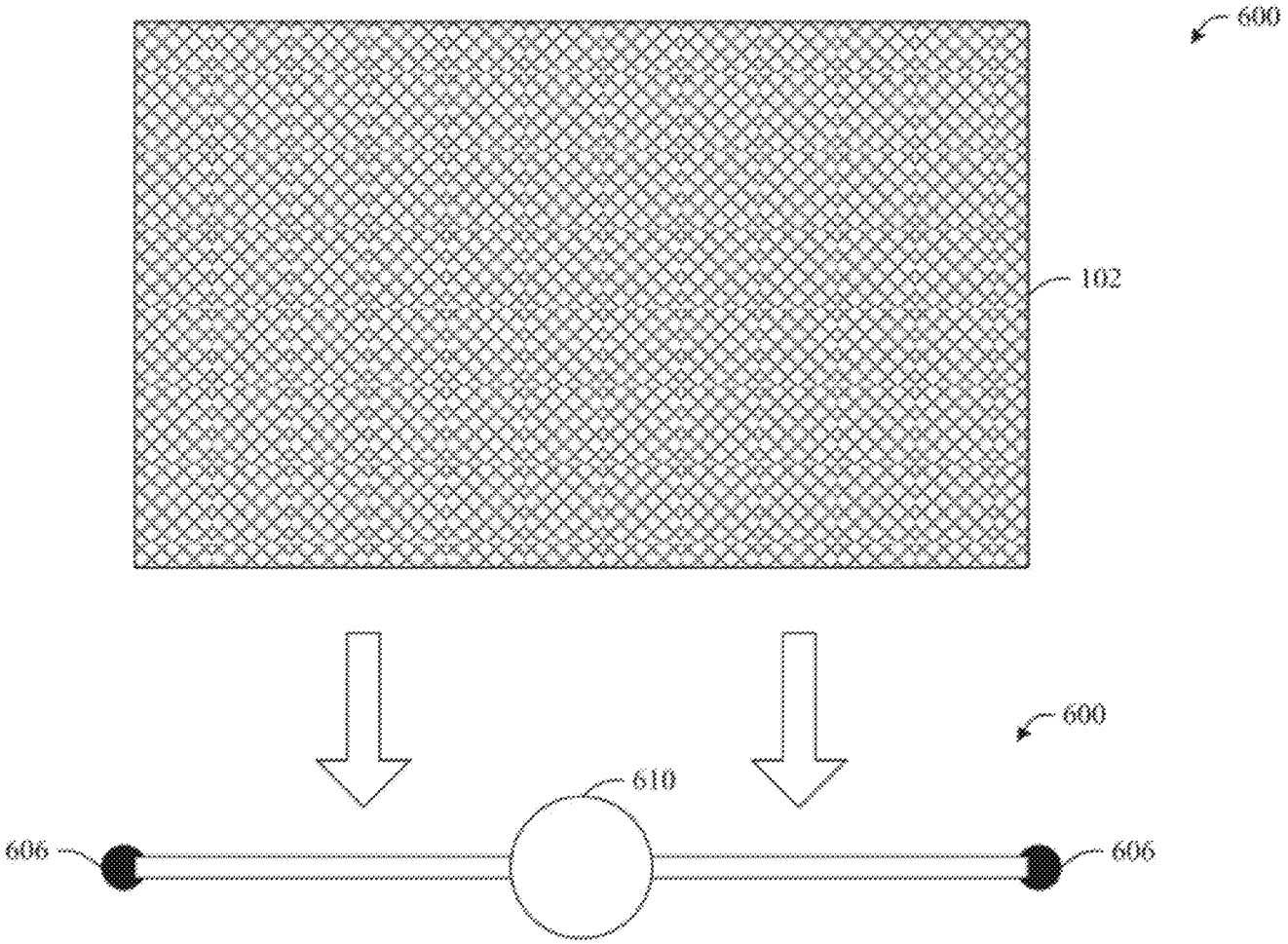
FIG. 7 illustrates insertion of a playing card into an illumination system in accordance with aspects.

Referring now to FIG. 7, a diagram of a levitating system 700 incorporating the levitation item 102 into the illumination system 600 of FIG. 6 is shown in accordance with an aspect of the innovation. As shown, the levitation item 102, such as a playing card, can be slidably inserted into the illumination system 600 illustrated in FIG. 6. Once the levitation item 102 is inserted, the levitation illusion can be commenced whereby the levitation means 106 can be attached to the attachment pad 610 of the illumination system 600. Thereafter, the illumination devices 606 can be illuminated and the levitation item 102 spun. In an alternative embodiment, a switching means (not shown) can be used to toggle the illumination devices 606 on and off. As mentioned above, in another embodiment, the spinning effect (motion) of the levitation item 102 can effect turning the illumination devices 606 on and off as appropriate. In still yet another embodiment, the illumination devices 606 can be synchronized to music from an electronic device, such as but not limited to an MP3 player, to turn on an off and keep time to the music. In these aspects, the illumination devices 606 can be wirelessly and communicatively coupled to an electronic device such that illumination synchronizes with sound (e.g., music) as desired.

Figure 8:
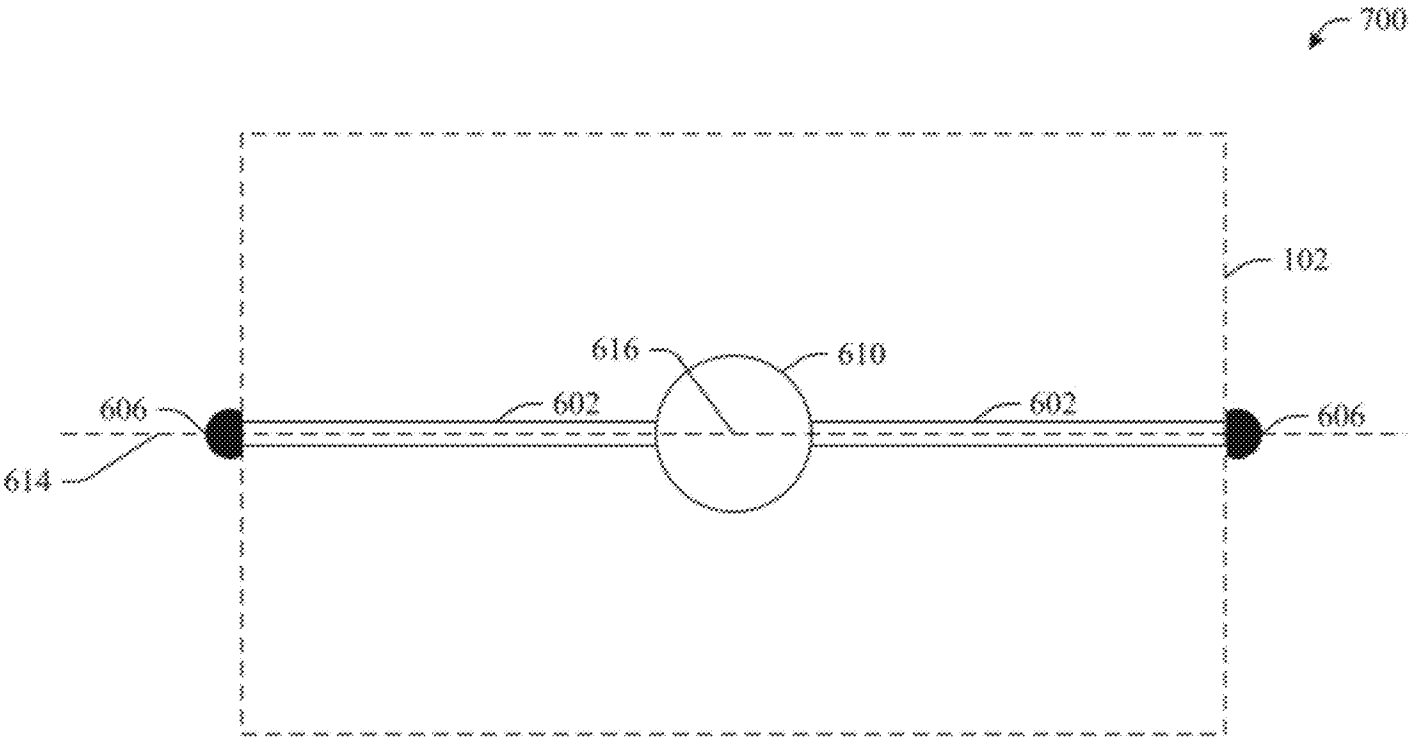
FIG. 8 illustrates a top view of an illumination system in accordance with aspects of the innovation.

Turning now to FIG. 8, a top view of the levitating system 700 is shown. As illustrated, the first member 602 and hence, the second member 604, which is hidden are positioned along a centerline 614 of the levitation item 102. Further, both the first and second members 602, 604 traverse the length of the levitation item 102. As a result, the attachment means 610 is positioned at a center 616 of the levitation item 102 so as to maintain balance and not to obscure, obstruct or affect the spinning motion of the card. It is to be appreciated, however, that the first and second members 602, 604 can traverse the levitation item 102 in any direction or orientation, such as but not limited to, a width direction, a diagonal direction, etc., as long as not to affect the equilibrium of the levitation item 102.

Figure 9:
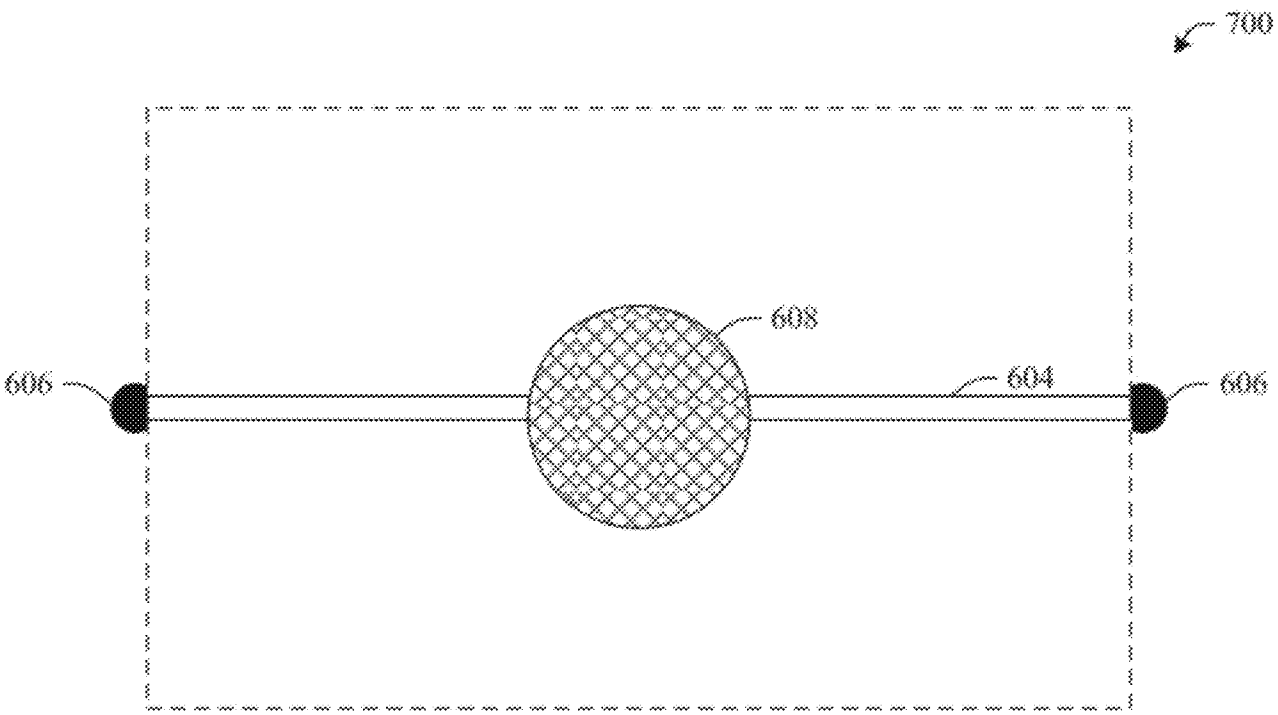
FIG. 9 illustrates a bottom view of an illumination system in accordance with aspects of the innovation.

FIG. 9 is an illustration of a bottom view of the illumination system 700 illustrating the location of the power source 608 in accordance with an aspect of the innovation. The power source 608 can be electrically coupled to the illumination devices 606 via the second member 604. Thus, upon engagement, the illumination devices 606 can be illuminated, for example while spinning.

Figure 10:
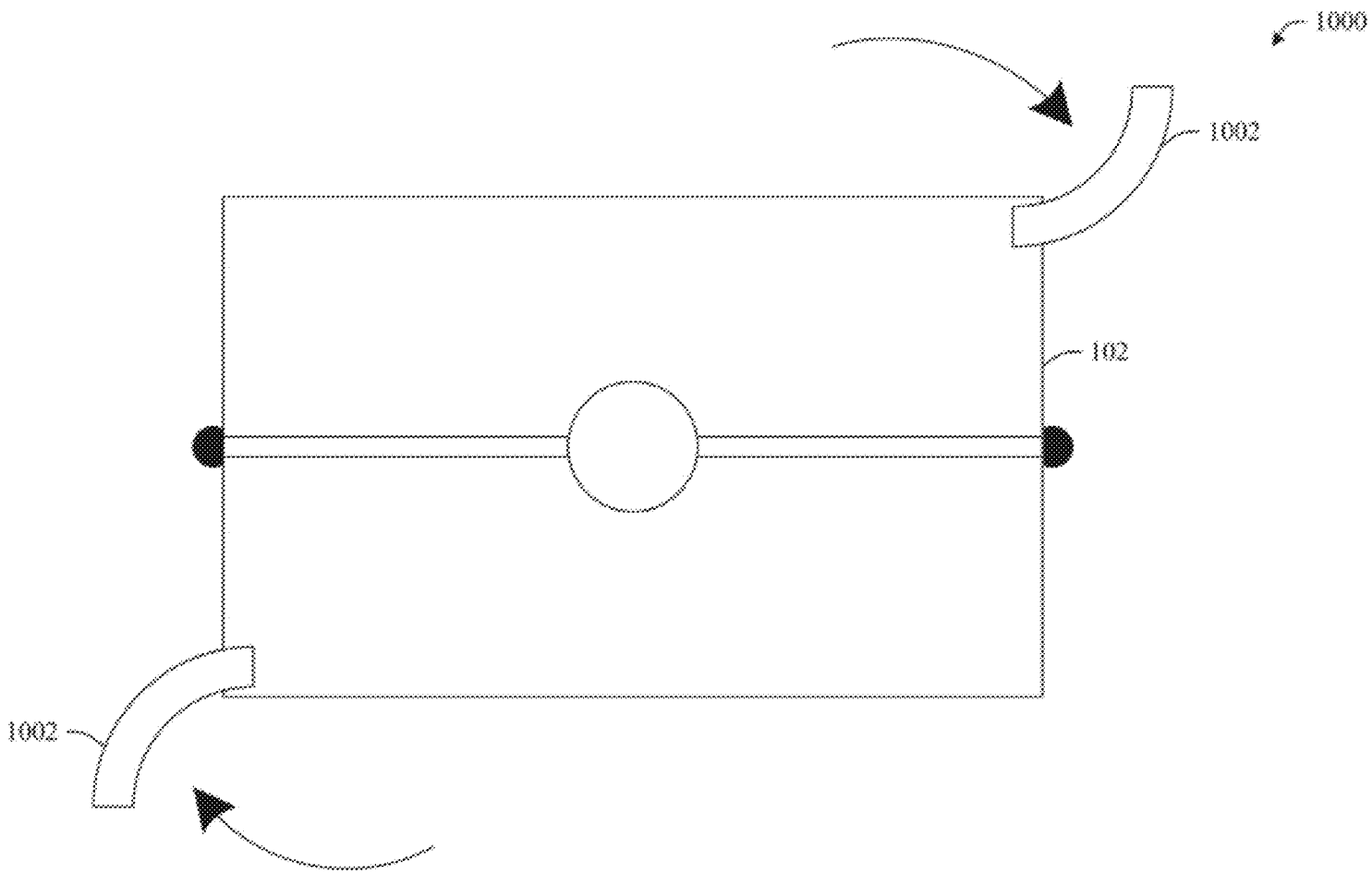
FIG. 10 illustrates an embodiment having spinning aides in accordance with aspects of the innovation.

FIG. 10 illustrates yet another aspect 1000 of the innovation that employs spinning aides 1002 which assist in spinning the levitation item 102 (e.g., card). As shown, the spinning aides 1002 can be positioned into or about the corners of the levitation item 102, such that the spinning aides 1002 are weighted to balance the levitation item 102. The spinning aides 1002 are configured (e.g., arched) so as to conform and assist in the spinning motion of the levitation item 102. In one aspect, the spinning aides 1002 can include a slot or channel into which the levitation item 102 can slidably attach. In another aspect, the spinning aides 1002 can be attached to the levitation item 102 via adhesives, clips, etc. While the spinning aides 1002 are shown in conjunction with the illumination system 600, it is to be understood that the spinning aides 1002 can be used separate from the illumination system 600 in an alternative embodiment.

Figure 11:
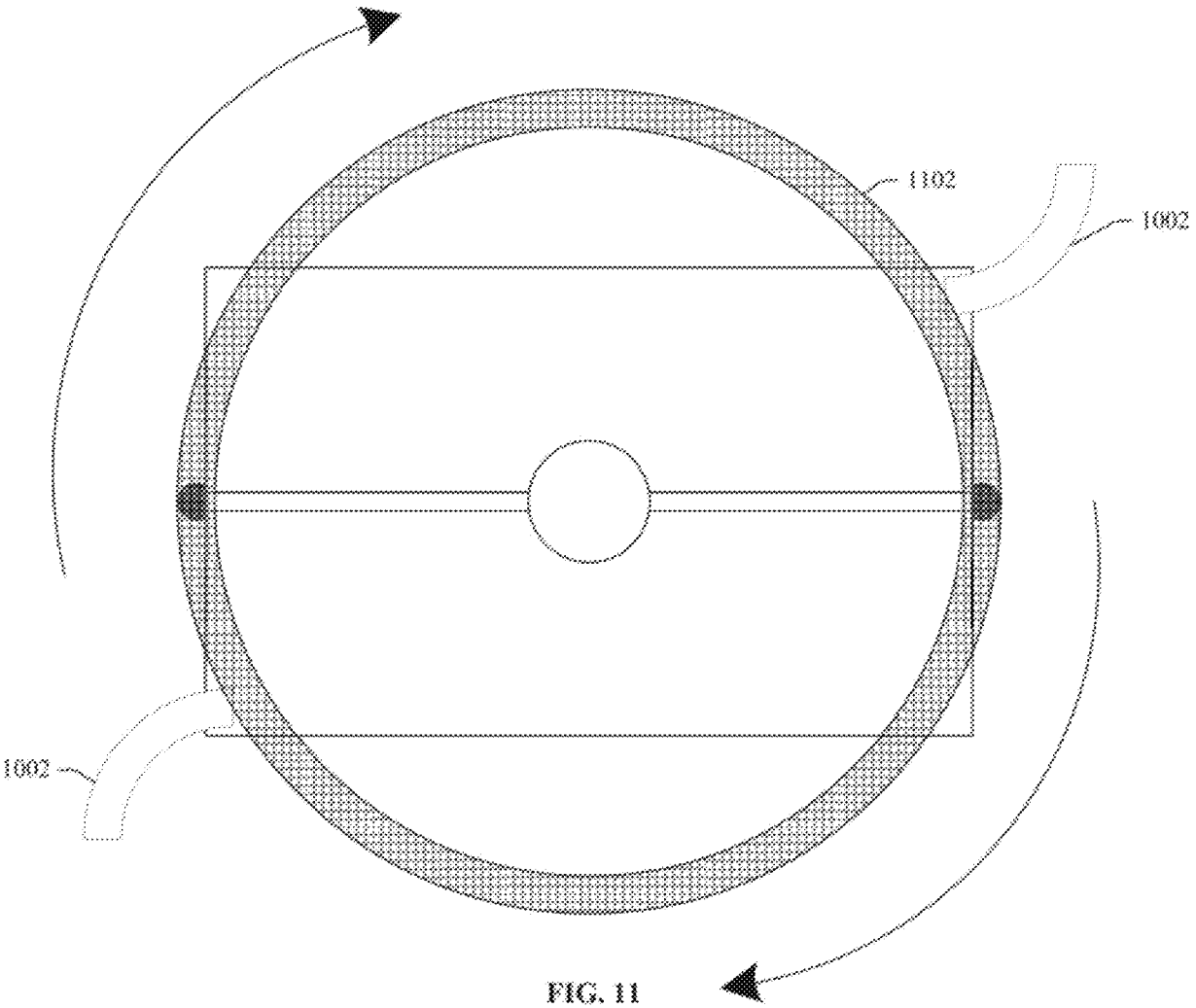
FIG. 11 illustrates an embodiment in motion in accordance with aspects of the innovation.

During operation, a user spins the levitation item 102 by exerting force upon one of the spinning aides 1002, as indicated by the arrow. If the spinning aides 1002 are used in conjunction with the illumination system, an illumination circle 1102 can be seen as shown in FIG. 11. It will be understood that the motion of the illumination devices 606 in a circular pattern can appear as an illuminated circle about the center of the levitation item 102. While specific examples, configurations and orientations are shown and described herein, it is to be understood that other aspects exist that employ the features, functions and benefits of this innovation. As such, these alternatives are to be included within the scope of this disclosure and claims appended hereto.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system that facilitates an illusion of levitating an item comprising:

a levitation item;

a connection means attached to a user;

a levitation means providing a connection between the levitation item and the connection means, wherein the levitation means provides a means to facilitate the illusion of floating the levitation item based on actions of the user; and a plurality of spinning aides removably attached to the levitation item, the plurality of spinning aides assist in a spinning the levitation item.

2. The system of claim 1, wherein the connection means is a device connected to a head of the user.

3. The system of claim 2, wherein the connection means is an ear piece.

4. The system of claim 3, wherein the ear piece is an over-the-ear piece.

5. The system of claim 4, wherein the over-the-ear device is a plastic device configured to fit around an ear of the user and wherein the levitation means is pre-attached to the over-the-ear device.

6. The system of claim 2, wherein the connection means is one of eyewear, headwear or a hair accessory.

7. The system of claim 1, further comprising an attachment means to attach a first end of the levitation means to the connection means and a second end of the levitation means to a center of the levitation item such that the levitation item is balanced.

8. The system of claim 7, wherein the attachment means is a pliable material.

9. The system of claim 8, wherein the pliable material is wax.

10. The system of claim 1, wherein the levitation item is one of a playing card, credit card, coin, or ball.

11. The system of claim 1, wherein the levitation means is one of thread, string or fishing line.

12. The system of claim 1, wherein the levitation means can be any color and/or transparent so as to appear substantially invisible to thereby conceal the levitation means from view.

13. The system of claim 1, further comprising at least one illumination device disposed on opposite ends of the levitation item, wherein the illumination sources generate a circle of light.

14. The system of claim 1, wherein the spinning aides are weighted and arched, and are attached to the levitation item such that the levitation item is balanced.

15. A system that facilitates an illusion of levitating an illuminated item comprising:

a levitation item;

a first member sizably configured to the levitation item;

a second member sizably configured to the levitation item, wherein the second member attaches to the first member about a centerline of the levitation item;

a connection means attached to a user;

a levitation means providing a connection between the levitation item and the connection means;

at least one illumination device disposed on opposite ends of the first member and/or the second member wherein, upon rotation of the item, the illumination sources generate a circle of light; and a plurality of spinning aides removably attached to the levitation item, the plurality of spinning aides assist in a spinning the levitation item.

16. The system of claim 15, further comprising an attachment pad positioned on top of the item, wherein the levitation means attaches to the attachment pad to affect the levitating illuminated illusion.

17. The system of claim 15, further comprising a power source compartment positioned below the item and disposed about a centerline between the first and second member, wherein the power source compartment houses a power source to power the illumination devices.

18. The system of claim 17, wherein the illumination devices are LED's.

19. The system of claim 17, wherein the power source is a battery.

20. The system of claim 15, wherein the connection means is an over-the-ear type ear piece.

21. The system of claim 20, wherein the over-the-ear device is a plastic device configured to fit around an ear of the user and wherein the levitation means is pre-attached to the over-the-ear device.

22. A system that facilitates illumination in an illusion of levitating an item comprising:

a first member sizably configured to the item;

a second member sizably configured to the item, wherein the second member attaches to the first member about a centerline of the item;

at least one illumination device disposed on opposite ends of the first member and/or the second member wherein, upon rotation of the item, the illumination sources generate a circle of light; and one or more spinning aides removably attached to the item, one or more of the spinning aides assist in a spinning the item, wherein one or more of the spinning aides are weighted and arched, and are attached to the item such that the item is balanced.

23. The system of claim 22, wherein the first member attaches to the second member via at least one of magnets, clips, tabs, or adhesives.

24. The system of claim 22, wherein the at least one of the first or second member is transparent.

25. The system of claim 22, further comprising a power source compartment positioned below the item and disposed about a centerline between the first and second member, wherein the power source compartment houses a power source to power the illumination devices.

26. The system of claim 25, wherein the illumination devices are LED's.

27. The system of claim 26, further comprising a switching means to toggle the illumination devices on and off.

28. The system of claim 22, wherein the illumination devices are one of a glow in the dark device or a device that illuminates upon motion not requiring an external power source.

29. The system of claim 22, further comprising an attachment pad positioned on top of the item, wherein a levitation means can be connected to affect the levitation illusion.

* * * * *